US005739831A

United States Patent [19]

Nakamura et al.

[11] Patent Number: 5,739,831

[45] Date of Patent: Apr. 14, 1998

[54] ELECTRIC FIELD DRIVEN INK JET PRINTER HAVING A RESILIENT PLATE DEFORMABLE BY AN ELECTROSTATIC ATTRACTION FORCE BETWEEN SPACED APART ELECTRODES

[75] Inventors: Haruo Nakamura; Norihiko Kurashima; Makoto Matsuzaki, all of Nagano, Japan

[73] Assignee: Seiko Epson Corporation, Tokyo, Japan

[21] Appl. No.: 528,707

[22] Filed: Sep. 15, 1995

[30] Foreign Application Priority Data

Sep. 16, 1994 [JP] Japan ..... 6-248517
Aug. 23, 1995 [JP] Japan ..... 7-237610

[51] Int. Cl.[6] ..... B41J 2/14; B41J 2/16; B41J 2/06

[52] U.S. Cl. ..... 347/51; 347/54; 347/55

[58] Field of Search ..... 347/51, 288, 239, 347/55, 225, 250, 54

[56] References Cited

U.S. PATENT DOCUMENTS 4,312,009 1/1982 Lange ..... 347/51

FOREIGN PATENT DOCUMENTS 0 095 911 12/1983 European Pat. Off. ..... B41J 3/04
0 402 172 12/1990 European Pat. Off. ..... B41J 2/045
354156634 12/1979 Japan ..... B41J 3/04
60-161158 12/1985 Japan ..... B41J 3/04
6-106725 4/1994 Japan ..... B14J 2/045

*Primary Examiner*—Benjamin R. Fuller
*Assistant Examiner*—Thien Tran
*Attorney, Agent, or Firm*—Sughrue, Mion, Zinn, Macpeak & Seas, PLLC

[57] ABSTRACT

An ink jet print head of the electric-field drive type includes: a nozzle plate including a ink spouting hole; a resilient plate deformable when it receives an electrostatic attraction force; a pressure generating chamber structure formed between the nozzle plate and the resilient plate; a first electrode formed on the resilient plate, the first electrode being located corresponding to the pressure generating chamber structure; a second electrode spaced apart from the first electrode a distance corresponding to a predetermined gap, the second electrode being undeformable when receiving the electrostatic attraction force; a photo conductive layer, one surface of the photo conductive layer being electrically connected to the second electrodes; and a substrate made of transparent material, the substrate including a transparent electrode which is electrically connected to the other surface of the photo conductive layer, wherein the electrostatic attraction force generated between the first and second electrodes causes the pressure generating chamber structure to be expanded, and removal of the electrostatic attraction force allows the pressure generating chamber structure to be compressed, to thereby cause the pressure generating chamber structure to shoot forth ink droplets through the ink spouting hole of the nozzle plate.

18 Claims, 7 Drawing Sheets

ELECTRIC FIELD DRIVEN INK JET PRINTER HAVING A RESILIENT PLATE DEFORMABLE BY AN ELECTROSTATIC ATTRACTION FORCE BETWEEN SPACED APART ELECTRODES

BACKGROUND OF THE INVENTION

1. Field of the Invention

The present invention relates to an ink jet print head having an array of nozzle openings which ranges over the full width of a print sheet. More particularly, the invention relates to an ink jet print head of the electric-field drive type in which energy for jetting ink droplets is generated by deforming a resilient plate by an electric field.

2. Description of the Related Art

In the ink jet printer, the print head is provided with a plural number of units each comprising a pressure chamber, a nozzle communicatively connected to the pressure chamber, and a pressure generating element for causing a variation of a pressure in the pressure chamber. Print data is applied to the pressure generating elements, to thereby shoot forth ink droplets to a print sheet. The ink jet printer is superior to the wire impact printer in less noise generation, small size and light weight since the former uses a smaller number of required component parts than the latter.

There is a proposal to increase the printing speed of the printer. The proposed printer employs a line head having a number of nozzle openings arrayed in the direction of the width of a print sheet. A number of lead wires for signal transmission is indispensable to the printer which uses a piezoelectric vibrator or a resistance element serving as an actuator. The wiring structure of the printer is inevitably complex.

Japanese laied open Patent Publication No. Hei. 6-106725, for example, discloses a print head which is directed to the solving of the wiring structure problem. In the construction of the print head, the nozzles each includes a pair of solid and resilient electrodes oppositely disposed. The ink contained has a high dielectric constant. One of the paired electrodes is connected to a high voltage source, through a photo conductive layer. A light beam modulated by a print signal selectively renders the photo conductive layer conductive, to thereby drive related nozzles to shoot forth ink droplets.

In the print head, a light beam emitted from a light emission diode is modulated by print data. The photo conductive layer is scanned with the light beam containing print information. As the result of the scan by the light beam, a voltage of the high voltage source is selectively applied to the nozzles in accordance with the print data, so that ink is shot forth, by an electrostatic attraction force, from the nozzles selectively driven. This print head succeeds in eliminating the use of a mechanical energy generating source, such as a piezoelectric vibrator. This leads to simplification of the wiring structure. However, the print head still suffers from some problems to be solved. Ink is present in an ink path formed between the paired electrodes. Ink used is limited to only the ink of high dielectric constant. Conductive ink as aqueous ink is not available to the printer thus formed. The photo conductive layer serves as a pressure generating source for ink jetting, and undergoes a flexural motion. For this reason, a material resistive to good mechanical fatigue must be used for the photo conductive layer.

SUMMARY OF THE INVENTION

For the above background reasons, the present invention has an object to provide a novel and unique ink jet head of the electric-field drive type which allows the use of any kind of ink, and shoots forth ink droplets without the aid of a flexural displacement of the photo conductive layer.

Another object of the present invention is to provide a method of driving an ink jet head of the electric-field drive type which allows the use of any kind of ink, and shoots forth ink droplets without the aid of a flexural displacement of the photo conductive layer.

To achieve the above object, there is provided an ink jet print head of the electric-field drive type comprising: a nozzle plate including a ink spouting hole; a resilient plate deformable when it receives an electrostatic attraction force; a pressure generating chamber structure formed between two major surface, one of the major surfaces of the pressure generating chamber structure being hermetically covered with the nozzle plate and the other of the major surface being hermetically covered with the resilient plate; a first electrode formed on the resilient plate, the first electrode being located corresponding to the pressure generating chamber structure; a second electrode spaced apart from the first electrode a distance corresponding to a predetermined gap, the second electrode being undeformable when receiving the electrostatic attraction force; a photo conductive layer including two major surfaces, one of the major surface of the photo conductive layer being electrically connected to the second electrodes; and a substrate made of transparent material, the substrate including a transparent electrode which is electrically connected to the other of the major surface of the photo conductive layer, wherein the electrostatic attraction force generated between the first and second electrodes causes the pressure generating chamber structure to be expanded, and removal of the electrostatic attraction force allows the pressure generating chamber structure to be compressed, to thereby cause the pressure generating chamber structure to shoot forth ink droplets through the ink spouting hole of the nozzle plate.

DETAILED DESCRIPTION OF THE PREFERRED EMBODIMENTS

The preferred embodiments of the present invention will be described in details with reference to the accompanying drawings.

Figure 1:
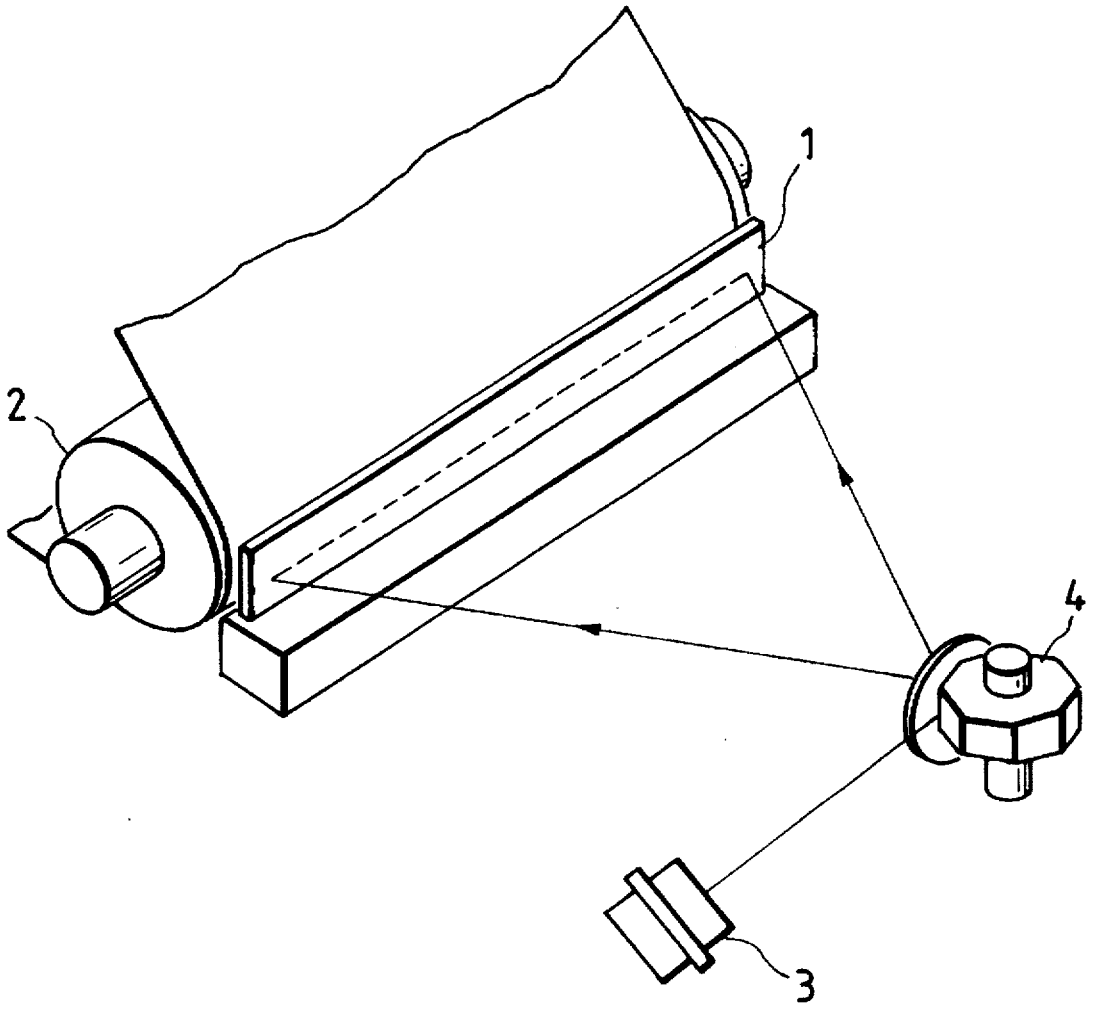
FIG. 1 is a view showing a part of a printing device which uses a print head according to the present invention.

FIG. 1 is a view showing a part of a printing device which uses a print head according to the present invention. A print head 1 according to the present invention is disposed facing a platen 2 while being extended in the axial direction of the platen 2. A polygon mirror 4 is located on the rear side of the print head 1. The polygon mirror 4 receives a light beam from a semiconductor laser element 3, and reflects it to the rear side in a scanning manner. The laser beam is modulated by a print signal. Further, an ink supply means 5 (FIG. 2) is located under the print head 1 such that it does not interrupt the scanning by the light beam.

Figure 2:
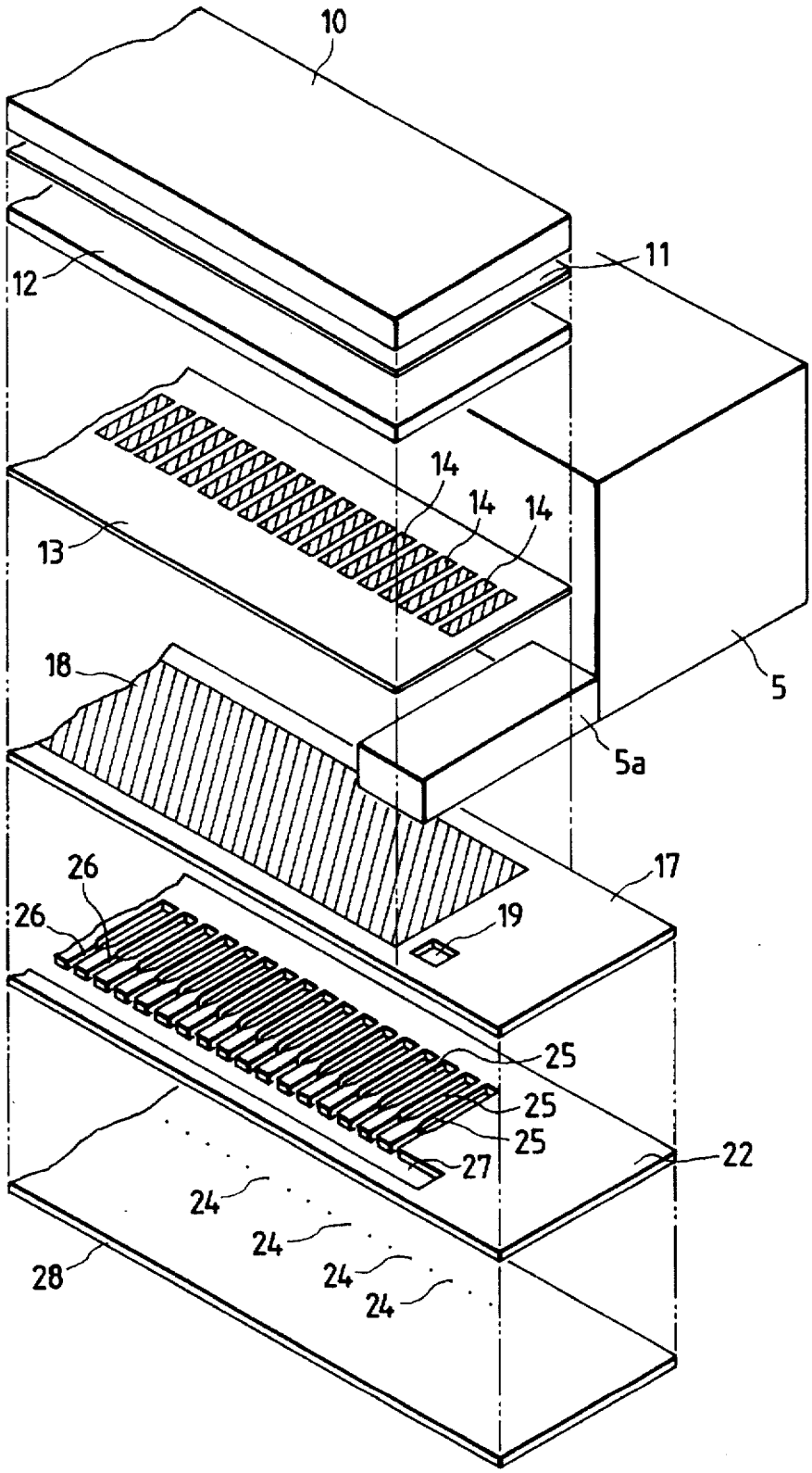
FIG. 2 is a perspective view showing an assembly of the print head according to a first embodiment of the present invention.
Figure 3:
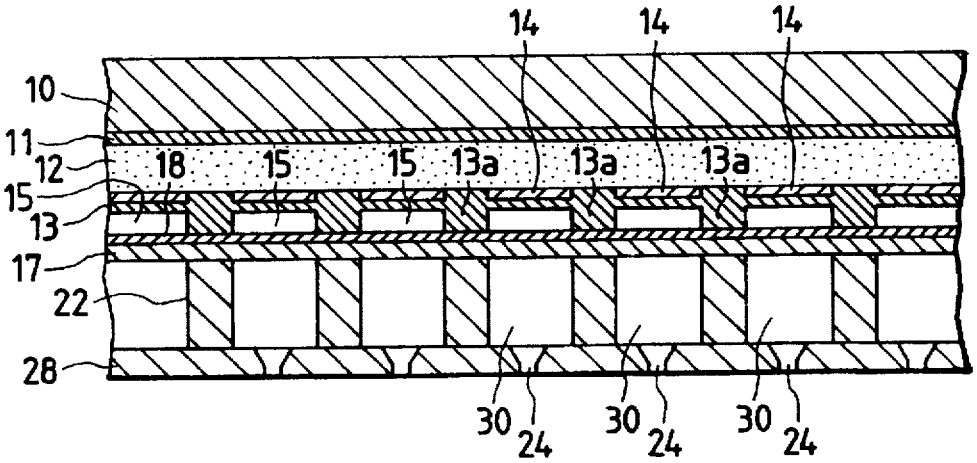
FIG. 3 is a cross sectional view showing the print head of FIG. 2.

FIGS. 2 and 3 show an embodiment of the print head according to the present invention. In the figures, a substrate 10 as a base of the print head is made of transparent material. In the embodiment, the substrate 10 is a plate of optical glass. The width and length of the substrate 10 are corresponding to those of the print head 1. A transparent electrode layer 11 is formed on the side of the substrate 10, which is closer to the nozzle openings, by vapor deposition process or sputtering.

A photo conductive layer 12 is made of photo conductive material, which is rendered conductive when it receives light. An example of the photo conductive material is amorphous silicon. A material having such an electric characteristic that the attenuation is considerably large up to the residual potential is used for the photo conductive material. High sensitivity photo conductive material of which the attenuation time is approximately 0.1 millisecond is used in this embodiment. One of the major surfaces of the photo conductive layer 12 is fastened onto the substrate 10 in a state that it is pressed against the transparent electrode layer 11.

Segment electrodes 14 are formed on the surface of an electrically insulating layer 13, while facing pressure generating chambers 30 to be described later, respectively. The segment electrodes 14 are made to directly contact with the photo conductive layer 12 in a state that those electrodes are electrically continuous to the photo conductive layer 12. The segment electrodes 14 have such a strength as not to be deformed under a high voltage applied thereto when ink is sucked (to be described later) because of the rigidity of the segment electrodes 14 per se and the rigidity of the photo conductive layer 12 and the substrate 10.

A resilient plate 17 is made of metal deformable under an electric field, ceramics, silicon or the like. A single common electrode 18 is formed over the surface of the resilient plate 17, which faces the insulating layer 13. Gaps 15 are formed between the insulating layer 13 and the resilient plate 17, and individually partitioned by protrusions 13*a*. The gaps 15 have each such a size that those gaps are deformable to such an extent as to allow ink to be shot forth from the pressure generating chambers 30. In this embodiment, the size of the gap is 0.2 to 3 μm. The other side of the resilient plate 17 is fastened on a fluid path forming plate 22 in a liquid tight manner.

An electric field required for shooting forth ink droplets is determined dependent on the area of each segment 14 and the size of each gap 15. The segment electrodes 14 may be disposed relatively flexibly. Accordingly, a large electric field can be used, while forming the gaps 15 that are large enough to secure such a quantity of displacement of the resilient plate 17 as to shoot forth ink droplets.

Since air is present in the gaps 15, the capacitance between the segment electrodes 14 and the common electrode 18 is small. When comparing with the ink jet print head using a piezoelectric vibrator, a drive voltage of the print head of the embodiment is higher, several hundreds V, but the power consumption thereof is approximately 1/10 to 1/100. Therefore, a power source of small capacity may be used when the print head of the invention is applied to the multi-nozzle.

The fluid path forming plate 22 includes through-holes 25, which will serve as pressure generating chambers 30. The through-holes 25 are arrayed at the same pitches as the nozzle openings 24. In the fluid path forming plate 22, a through-hole 27 is connected to the through-holes 25 by way of grooves 26. The through-hole 27 will serve as a common ink chamber. The through-hole 27 receives ink through an ink supply port 19 of the resilient plate 17. The through-holes 25 will be used as the pressure generating chambers 30.

A nozzle plate 28 includes the nozzle openings 24 linearly arrayed at preset pitches. The nozzle plate 28 is fastened on the front side of the fluid path forming plate 22 in a state that the nozzle openings 24 are communicatively connected to the through-holes 25, respectively. The through-holes 25 form the pressure generating chambers 30 of the resilient plate 17.

The thus constructed print head 1 is connected through an ink supply path 5*a* to the ink supply means 5, whereby it receives ink from the ink supply means 5.

An operation of the print head 1 thus constructed will be described with reference to FIGS. 4A to 4C.

Figure 4A:
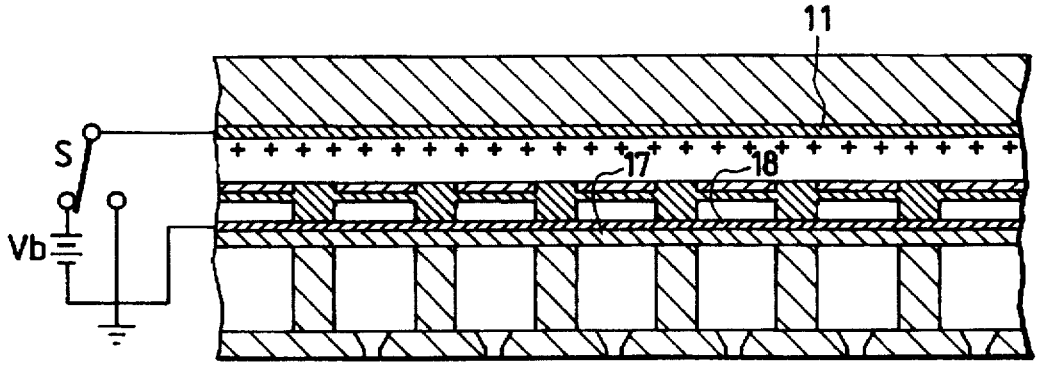
FIGS. 4A to 4C show a series of views useful in explaining a first method of driving the print head.
Figure 4B:
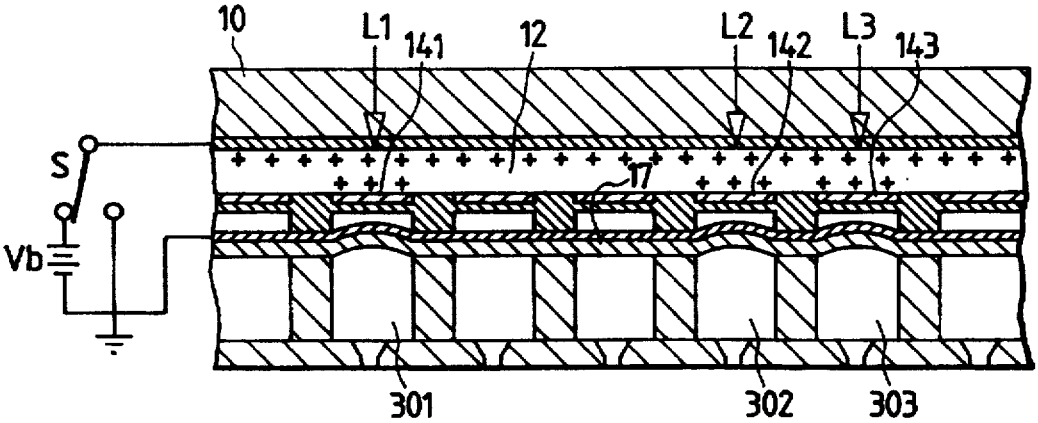

The common electrode 18 of the resilient plate 17 is connected to ground, while the transparent electrode layer 11 is connected to a bias voltage source Vb of several hundreds V (FIG. 4A).

In this state, the substrate 10 is longitudinally scanned with laser beams L1, L2 and L3, which are modulated by print data. Only the regions of the photo conductive layer 12, which are located corresponding to the dots be formed, are exposed to light. As the result of the light exposure, those regions are rendered conductive. Only the segment electrodes 141, 142 and 143, which are disposed facing the nozzle openings 24 located corresponding to the dots to be formed, are put at the potential equal to that of the bias voltage source Vb. In this state, the resilient plate 17 is electrostatically attracted toward the segment electrodes 141, 142 and 143 (FIG. 4B).

With the deformation of the resilient plate 17, the pressure generating chambers 301, 302 and 303 are expanded, so that ink flows from the ink supply means 5 into the pressure generating chambers 301, 302 and 303, through the grooves 26.

Within a duration that the photo conductive layer 12 is conductive, the potential of the transparent electrode layer 11 is changed to ground potential by a switch S. The segment electrodes 141, 142 and 143 and the common electrode 18 are placed at the same potential. In this state, the electrostatic attraction force disappears, and the resilient plate 17 returns to its original state by its restoring force. As a result, the pressure generating chambers are compressed, and the pressure therein increases to shoot forth ink droplets through the nozzle openings 241, 242 and 243 (FIG. 4C).

As shown in FIG. 1, the rear side or the substrate surface of the print head is scanned with a laser beam L modulated by print data, from one side of the rear side thereof in the direction S in successive order. Through the scan, the pressure generating chambers are selectively driven to shoot forth ink droplets through the nozzle openings 24.

There is no need of lead wires for connecting to exterior the segment electrodes 14 that is formed on the insulating layer 13. Only one lead wire is used for connecting the common electrode 18 to exterior. The transparent electrode layer 11 also uses only one lead wire for its connection to exterior. Then, the total number of lead wires required for the print head is only two. Thus, the wiring structure of the print head is considerably simplified.

The energy necessary for shooting forth ink droplets is formed in the resilient plate 17 and the insulating layer 13. This is caused by an electric field between the electrodes 14 and 18 oppositely disposed. Ink does not take part in the ink jetting operation. In other words, the ink jetting operation is free from the electric characteristic of ink. Any type of ink may be used for the print head of the present invention. The mechanical energy for the ink jetting operation depends only on the flexural displacement of the resilient plate 17. Hence, no mechanical fatigue occurs to the photo conductive layer 12.

Figure 4C:
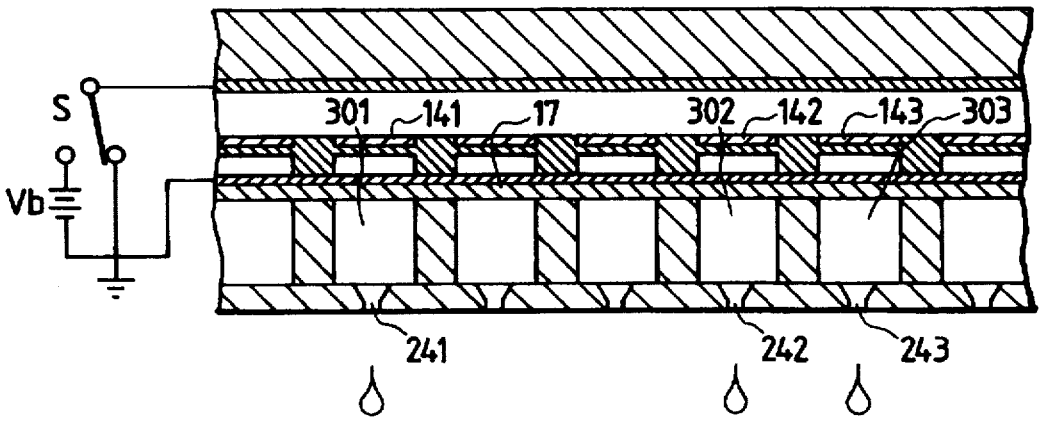

In the embodiment, the duration of the conductive state of the photo conductive layer 12 is continued up to a time point where the switch S is operated for changing the potential of the transparent electrode layer (FIG. 4C). When the conductive state of the photo conductive layer has a shorter duration, the requirement may be satisfied by additionally applying the laser beam to the photo conductive layer.

Figure 5A:
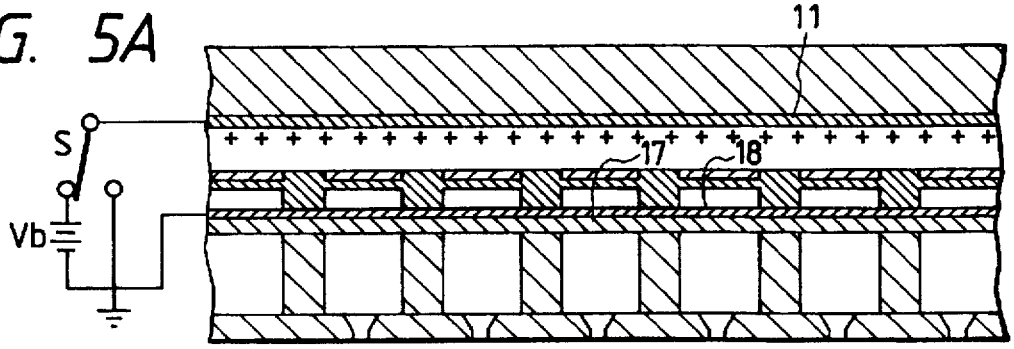
FIGS. 5A to 5D show a series of views useful in explaining a second method of driving the print head.

The common electrode 18 of the resilient plate 17 is connected to ground, while the transparent electrode layer 11 is connected to a bias voltage source Vb of several hundreds V (FIG. 5A).

Figure 5B:
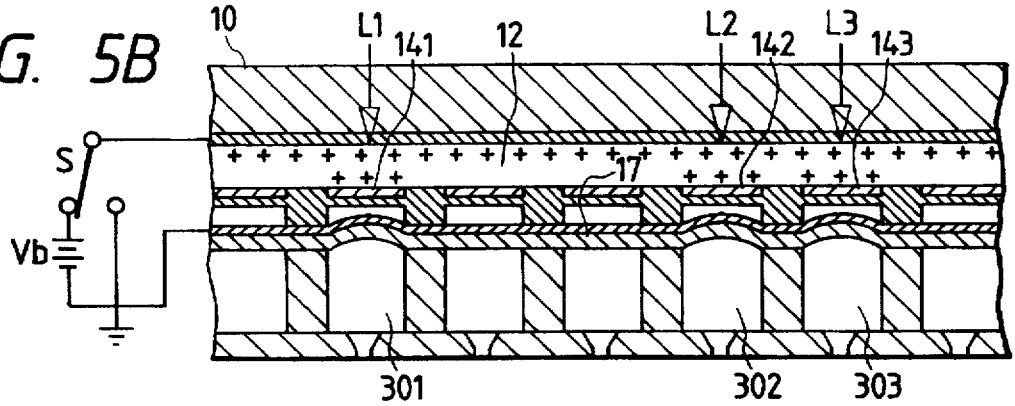
Figure 5C:
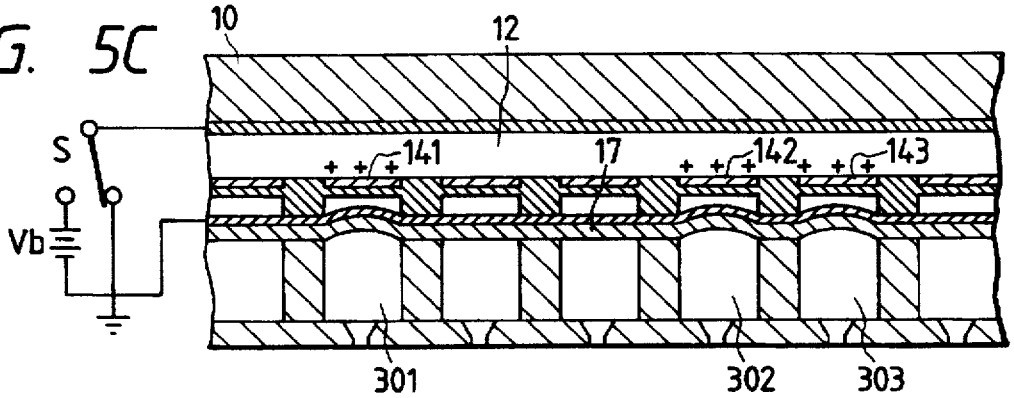

In this state, the substrate 10 of the print head is longitudinally scanned with laser beams L1, L2 and L3, which are modulated by print data. Only the regions of the photo conductive layer are exposed to light. As the result of the light exposure, those regions of the photo conductive layer 12 are rendered conductive. Only the segment electrodes 141, 142 and 143, which are disposed facing the nozzle openings 24 located corresponding to the dots to be formed, are put at the potential equal to that of the bias voltage source Vb. In this state, the resilient plate 17 is electrostatically attracted toward the segment electrodes 141, 142 and 143 (FIG. 5B).

With the deformation of the resilient plate 17, the pressure generating chambers 301, 302 and 303 are expanded, so that ink flows from the ink supply means 5 into the pressure generating chambers 301, 302 and 303, through the grooves 26.

At this time, the photo conductive layer 12 has been rendered nonconductive. Charge is still left in the segment electrodes 141, 142 and 143, and hence the resilient plate 17 is receiving the electrostatic attraction force.

Figure 5D:
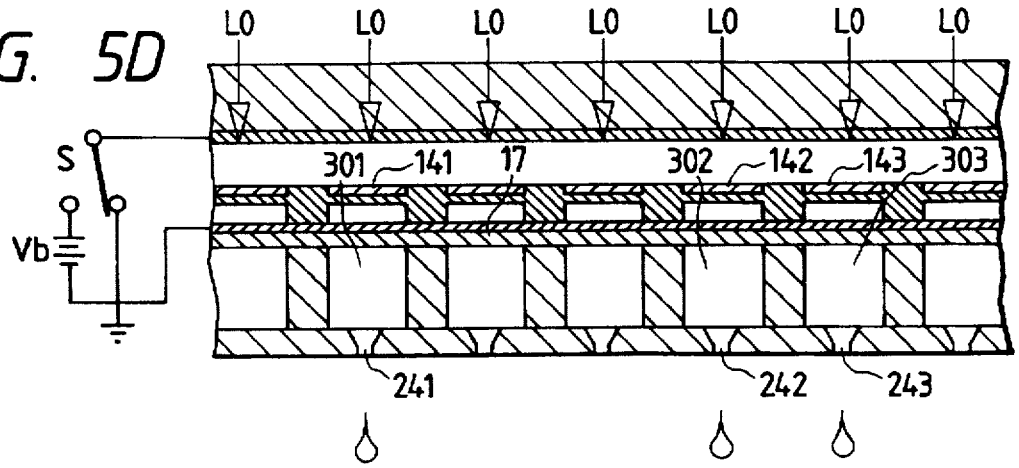

In this state, the transparent electrode layer 11 is connected to ground by the switch S, and laser beams Lo are projected again onto at least the regions of the photo conductive layer 12, which are located corresponding to the dots to be formed (FIG. 5D). Those regions of the photo conductive layer 12 are made conductive again, and the charge of the segment electrodes 141, 142 and 143 is discharged through the photo conductive layer 12, and the segment electrodes 141, 142 and 143 and the common electrode 18 are placed at the same potential. In this state, the electrostatic attraction force disappears, and the resilient plate 17 returns to its original state by its restoring force. As a result, the pressure generating chambers 301, 302 and 303 are compressed, and the pressure therein increases to shoot forth ink droplets through the nozzle openings 241, 242, and 243.

While the laser beam for writing data is used for the ink jetting operation in the above-mentioned embodiment, an LED array, an incandescent electric lamp, a halogen lamp or the like may be used for emitting the light beam for the ink jetting operation.

Figure 6:
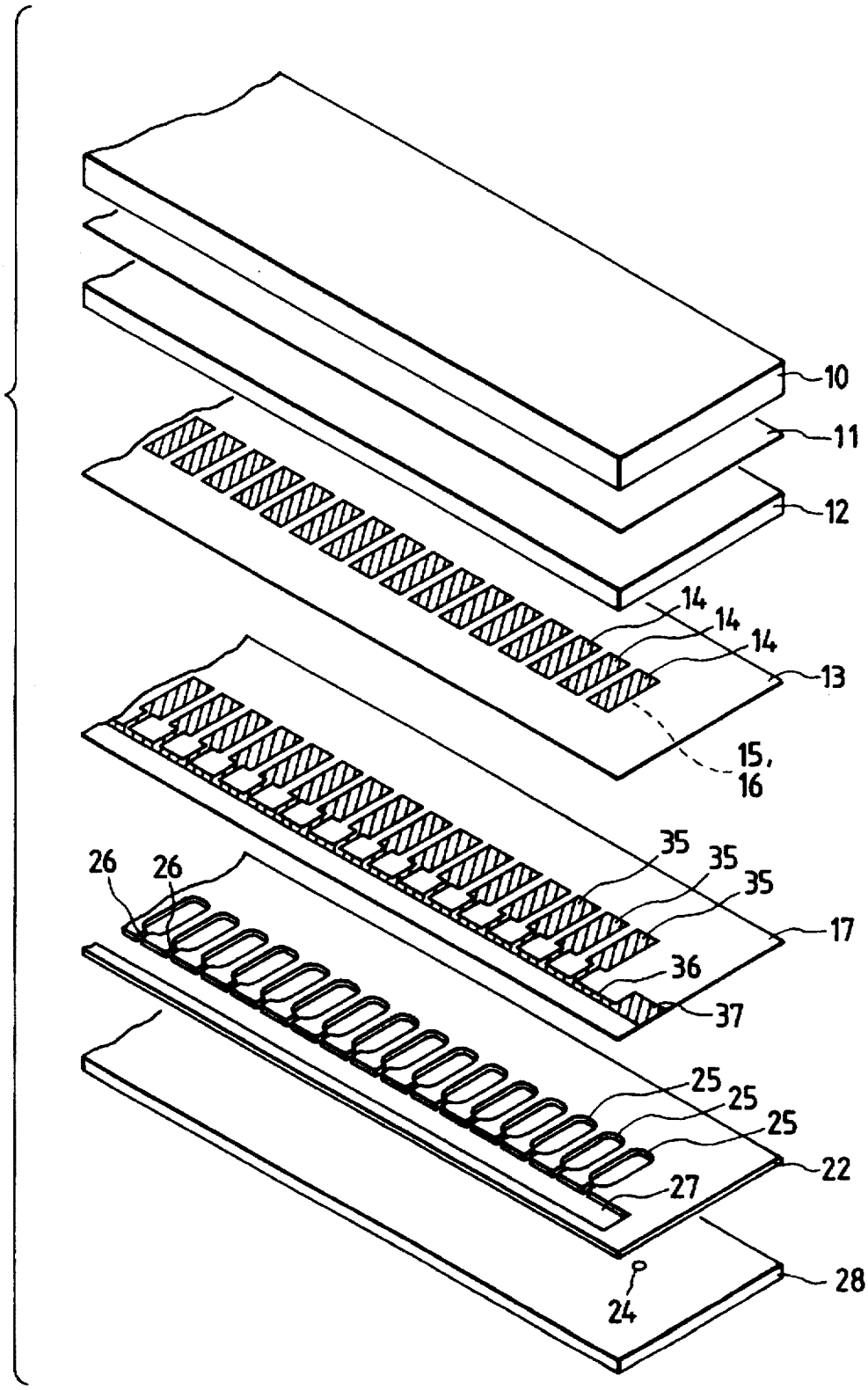
FIG. 6 is a perspective view showing an assembly of the print head according to a modification of the first embodiment of the present invention.

In the above-mentioned embodiment, a single electrode is used for the common electrode 18 on the resilient plate 17. An alternative of the common electrode 18 is shown in FIG. 6. As shown, a plural number of individual electrodes 35, like the segment electrodes 14, are formed on the resilient plate 17 at the locations corresponding to the pressure generating chambers 30. Those electrodes 35 are connected together by a conductive pattern 36, which is continuous to a terminal 37.

Figure 8:
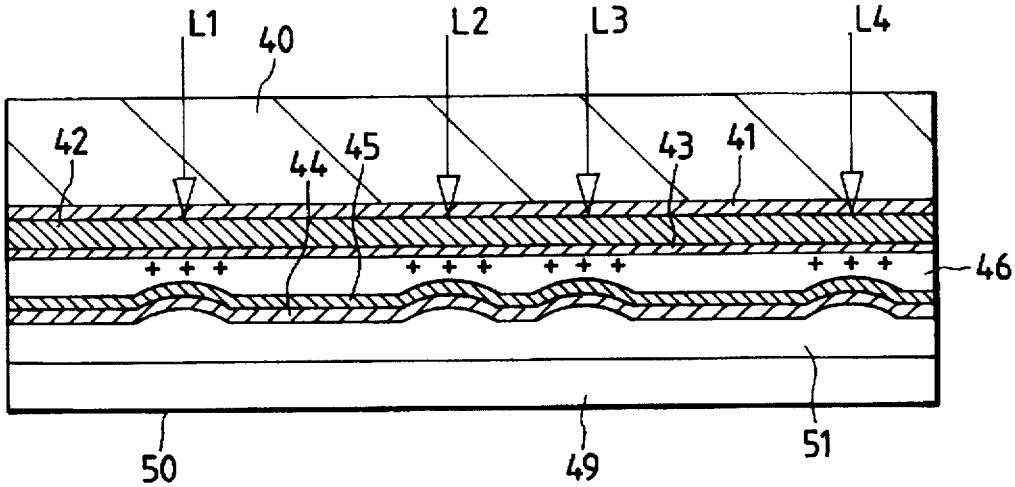
FIG. 8 is a sectional view useful in explaining the operation of the second embodiment.
Figure 7:
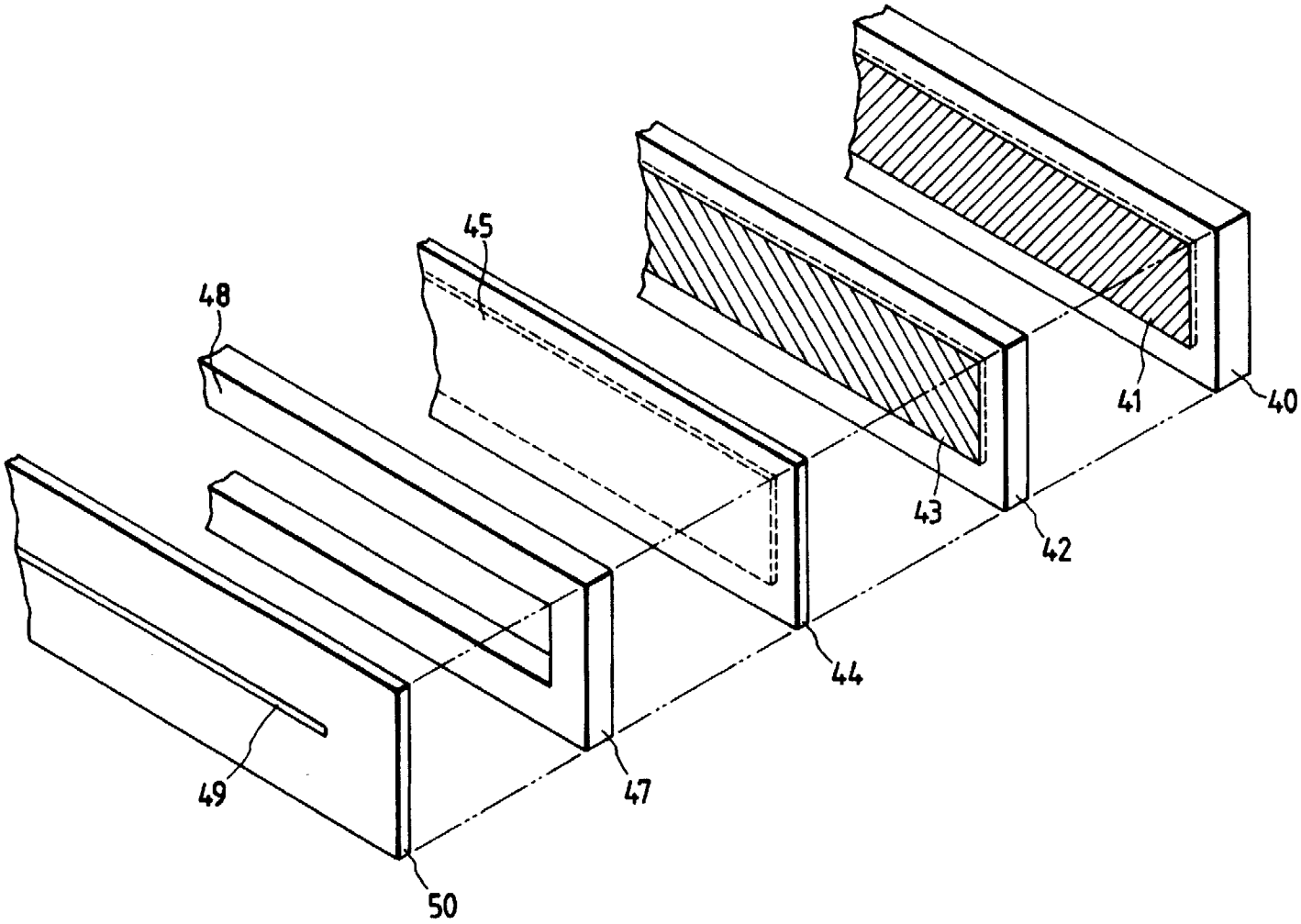
FIG. 7 is a perspective view showing an assembly of the print head according to a second embodiment of the present invention.

Turning now to FIGS. 7 and 8, there is shown a second embodiment of a print head according to the present invention. In the figure, reference numeral 40 designates a substrate made of transparent material. The width and length of the substrate 40 are corresponding to those of the print head 1. A transparent electrode layer 41 is formed on the side of the substrate 40, which is closer to a nozzle plate 50, by vapor deposition process or sputtering.

A photo conductive layer 42 is made of amorphous silicon, which is rendered conductive when it receives light. One of the major surfaces of the photo conductive layer 42 is fastened onto the substrate 40 in a state that it is pressed against the transparent electrode layer 41.

A first common electrode 43 has such a strength as not to be deformed when it receives an electrostatic attraction force because of its rigidity and the rigidity of the photo conductive layer 42 and the substrate 40. The first common electrode 43 is formed over the other side of the photo conductive layer 42 while being located corresponding to a pressure generating chamber 51.

A resilient plate 44 is made of metal deformable when it receives an electric field, or ceramics also deformable. A second common electrode 45 is formed over one of the major surfaces of the resilient plate 44, which faces the first common electrode 43. The other major surface of the resilient plate 44 is liquid tightly fastened onto a fluid path forming plate 47, with a gap 46 (FIG. 8) located therebetween. The gap 46 has such a size that it is deformable to such an extent as to allow ink to be shot forth from the pressure generating chamber 51. In this embodiment, the size of the gap 46 is of 0.2 to 3 μm.

The fluid path forming plate 47 includes an elongated hole 48, which is extended in the longitudinal direction of the print head. One of the sides of the fluid path forming plate 47 is hermetically covered with the resilient plate 44, while the other is hermetically covered with the nozzle plate 50, whereby the pressure generating chamber 51 is formed. The nozzle plate 50 includes a slit 49.

Also in the second embodiment, the transparent electrode layer 41 is connected to a bias voltage source, and the second common electrode 45 of the resilient plate 44 is grounded. As shown in FIG. 8, laser beams L1, L2, L3 and L4 are projected onto the regions of the photo conductive layer 42 which are located corresponding to the portions requiring the jetting of ink droplets. Those regions of the photo conductive layer 42, exposed to laser beams, are rendered conductive. The potential of the first common electrode 43, which is layered on the other side of the photo conductive layer, is raised up to the bias potential at the regions thereof, which are located corresponding to the conductive regions of the photo conductive layer 42. The regions of the second common electrode 45, which are located corresponding to the regions exposed to laser beams, receive an electrostatic attraction force. As a result, the corresponding regions of the resilient plate 44 are elastically deformed toward the photo conductive layer 42.

In this state, the potential of the transparent electrode layer 41 is changed to ground potential. In turn, the resilient plate 44 is released from the electrostatic force, and returns to its original state. At this time, an impact pressure is generated at the deformed regions of the resilient plate 44, and causes ink to be shot forth in the form of droplets from the pressure generating chamber 51 through the second common electrode 45.

As seen from the foregoing description, an ink jet print head of the electric-field drive type comprises: a pressure generating chamber structure communicatively connected to an ink supply means, one of the major surfaces of the pressure generating chamber structure being hermetically covered with a nozzle plate with ink spouting holes, while the other being hermetically covered with a resilient plate deformable when it receives an electrostatic attraction force; a first electrode being formed over an area on the resilient plate, which is located corresponding to the pressure generating chamber structure; second electrodes, undeformable when receiving the electrostatic attraction force, being spaced apart from the first electrode a distance corresponding to a predetermined gap; a photo conductive layer being disposed so that one of the major surfaces of the photo conductive layer is electrically continuous to the second electrodes; and a substrate being made of transparent material, a transparent electrode which is electrically continuous to the other major surface of the photo conductive layer being formed over the substrate. With such a structure, no ink is present between the first and second electrodes. Accordingly, the print head of the invention allows the use of the ink of high dielectric constant and aqueous ink as well. A flexural displacement for causing the ink spouting occurs in the resilient plate, which is spaced from the photo conductive layer. Accordingly, the photo conductive layer is free from a mechanical fatigue.

The first electrode may be formed in a plane. The second electrode may also be formed in a plane. In other words, those electrodes may be two-dimensionally arrayed. These must be alternately layered in three-dimensionally fashion in the conventional ink jet print head of the electric-field drive type. Accordingly, the print head having a plural number of nozzle series, which is for color printing and extremely high density printing, may more readily be realized when the present invention is used.

What is claimed is:

1. An electric-field driven ink jet print head, comprising:

a nozzle plate including an ink spouting hole;

a resilient plate deformable when an electrostatic attraction force is applied thereto;

a pressure generating chamber structure formed between two major surfaces, one of said major surfaces of said pressure generating chamber structure being hermetically covered with said nozzle plate and another of said major surfaces being hermetically covered with said resilient plate, such that said pressure generating chamber structure, said nozzle plate and said resilient plate form walls of a pressure generating chamber;

a first electrode formed on said resilient plate, said first electrode being located corresponding to said pressure generating chamber;

a second electrode spaced apart from said first electrode a distance corresponding to a predetermined gap, said second electrode being undeformable when receiving the electrostatic attraction force;

a substrate made of transparent material, said substrate including a transparent electrode;

means for switching a potential of said transparent electrode between a potential of said first electrode and another potential; and a photo conductive layer formed between said second electrode and said substrate, said photo conductive layer selectively conducting in accordance with light signals received through said substrate such that portions of said second electrode are set to said another potential, thereby generating the electrostatic attraction force between said first electrode and second electrode across said gap;

wherein the electrostatic attraction force generated between said first and second electrodes causes said pressure generating chamber to expand into said gap, and removal of the electrostatic attraction force, by switching the potential of said transparent electrode to the potential of said first electrode, allows said pressure generating chamber to compress, to thereby cause said pressure generating chamber to shoot forth ink droplets through said ink spouting hole of said nozzle plate.

2. The ink jet print head according to claim 1, wherein a surface of said substrate receives a projected light beam modulated by a print signal.

3. The ink jet print head according to claim 1, wherein the ink jet print head includes a series of nozzle openings arrayed at fixed pitches formed in said nozzle plate, wherein said pressure generating chamber comprises a plurality of segmented chambers which correspond to said nozzle openings, and wherein said second electrode comprises individual segment electrodes.

4. The ink jet print head according to claim 2, wherein the ink jet print head includes a plurality of pressure generating chambers, wherein said first electrode comprises a conductive pattern and a plurality of first segmented electrodes connected in parallel, which correspond to said pressure generating chambers.

5. The ink jet print head according to claim 1, said ink spouting hole comprises a single slit.

6. The ink jet print head according to claim 1, further comprising an insulating layer provided between said first electrode and second electrode.

7. A method of driving an electric-field driven ink jet print head, comprising the steps of:

(a) providing the ink jet print head including:

a nozzle plate including an ink spouting hole;

a resilient plate deformable when an electrostatic attraction force is applied thereto;

a pressure generating chamber structure formed between two major surfaces, one of the major surfaces of the pressure generating chamber structure being hermetically covered with the nozzle plate and another of the major surfaces being hermetically covered with the resilient plate, such that said pressure generating chamber structure, said nozzle plate and said resilient plate form walls of a pressure generating chamber;

a first electrode formed on the resilient plate, the first electrode being located corresponding to the pressure generating chamber;

a second electrode spaced apart from the first electrode a distance corresponding to a predetermined gap, the second electrode being undeformable when receiving the electrostatic attraction force;

a substrate made of transparent material, the substrate including a transparent electrode;

means for switching a potential of said transparent electrode between a potential of said first electrode and another potential; and a photo conductive layer formed between said second electrode and said substrate;

(b) applying a voltage to the transparent electrode large enough to deform the resilient plate;

(c) generating the electrostatic attraction force between said first electrode and second electrode across said gap by writing projecting light onto a region of the photo conductive layer, such that the region of the photo conductive layer conducts to raise a potential of a portion of the second electrode located corresponding to a location requiring jetting of an ink droplet; and (d) spouting the ink droplet by setting a potential of the transparent electrode to a potential of the first electrode.

8. A method of driving an electric-field driven ink jet print head, comprising the steps of:

(a) providing the ink jet print head including:

a nozzle plate including an ink spouting hole;

a resilient plate deformable when an electrostatic attraction force is applied thereto;

a pressure generating chamber structure formed between two major surfaces, one of the major surfaces of the pressure generating chamber structure being hermetically covered with the nozzle plate and another of the major surfaces being hermetically covered with the resilient plate, such that said pressure generating chamber structure, said nozzle plate and said resilient plate form walls of a pressure generating chamber;

a first electrode formed on the resilient plate, the first electrode being located corresponding to the pressure generating chamber;

a second electrode spaced apart from the first electrode a distance corresponding to a predetermined gap, the second electrode being undeformable when receiving the electrostatic attraction force;

a substrate made of transparent material, the substrate including a transparent electrode;

means for switching a potential of said transparent electrode between a potential of said first electrode and another potential; and a photo conductive layer formed between said second electrode and said substrate;

(b) applying a voltage to the transparent electrode large enough to deform the resilient plate;

(c) generating the electrostatic attraction force between said first electrode and second electrode across said gap by writing projecting light onto a region of the photo conductive layer, such that the region of the photo conductive layer conducts to raise a potential of a portion of the second electrode located corresponding to a location requiring jetting of an ink droplet; and (d) spouting the ink droplet by setting a potential of the transparent electrode to a potential of the first electrode by projecting light beams onto at least the region of the photo conductive layer, located corresponding to the portion requiring the jetting of ink droplet.

9. The print head driving method according to claim 7, wherein said generating step of writing projecting light onto the photo conductive layer includes scanning the photo conductive layer with a laser beam modulated by a print signal.

10. The print head driving method according to claim 8, wherein said writing step includes using a light source for emitting said projecting light and said spouting step includes using said light source for projecting said light beams.

11. The print head driving method according to claim 8, wherein said writing step includes using a first light source for emitting said projecting light and said spouting step includes using a second light source for projecting said light beams.

12. The print head driving method according to claim 8, wherein said generating step of writing projecting light onto the photo conductive layer includes scanning the photo conductive layer with a laser beam modulated by a print signal.

13. The ink jet print head according to claim 1, wherein said gap is filled with air.

14. The ink jet print head according to claim 6, wherein said gap is formed in said insulating layer.

15. The method of driving an ink jet print head according to claim 7, wherein said applying step includes deforming said first electrode into said gap filled with air.

16. The method of driving an ink jet head according to claim 7, wherein said providing step further comprising the step of reducing said predetermined gap by forming an insulating layer between first electrode and second electrode, wherein said applying step includes deforming said first electrode into said reduced gap formed in said insulating layer.

17. The method of driving an ink jet print head according to claim 8, wherein said applying step includes deforming said first electrode into said gap filled with air.

18. The method of driving an ink jet head according to claim 7, wherein said providing step further comprising the step of reducing said predetermined gap by forming an insulating layer between first electrode and second electrode, wherein said applying step includes deforming said first electrode into said reduced gap formed in said insulating layer.

* * * * *